US010123667B2

(12) United States Patent
Miura

(10) Patent No.: US 10,123,667 B2
(45) Date of Patent: Nov. 13, 2018

(54) HOUSEHOLD TISSUE CASE

(71) Applicant: DAIO PAPER CORPORATION, Ehime (JP)

(72) Inventor: Akiteru Miura, Ehime (JP)

(73) Assignee: DAIO PAPER CORPORATION, Ehime (JP)

( * ) Notice: Subject to any disclaimer, the term of this patent is extended or adjusted under 35 U.S.C. 154(b) by 0 days.

(21) Appl. No.: 15/509,931

(22) PCT Filed: Sep. 29, 2015

(86) PCT No.: PCT/JP2015/077579
§ 371 (c)(1),
(2) Date: Mar. 9, 2017

(87) PCT Pub. No.: WO2016/052539
PCT Pub. Date: Apr. 7, 2016

(65) Prior Publication Data

US 2017/0303749 A1 Oct. 26, 2017

(30) Foreign Application Priority Data

Sep. 30, 2014 (JP) ..... 2014-201106

(51) Int. Cl.
*B65D 83/08* (2006.01)
*A47K 10/42* (2006.01)
(Continued)

(52) U.S. Cl.
CPC ..... *A47K 10/421* (2013.01); *A47K 10/20* (2013.01); *A47K 10/42* (2013.01); *B65D 83/08* (2013.01);
(Continued)

(58) Field of Classification Search
CPC ..... A47K 10/421; A47K 10/20; B65D 83/08
(Continued)

(56) References Cited

U.S. PATENT DOCUMENTS 4,848,575 A * 7/1989 Nakamura ..... B65D 83/0805 206/449
2002/0179626 A1* 12/2002 Huang ..... B65D 83/0805 221/63
2007/0215632 A1* 9/2007 Bendor ..... A47K 10/42 221/63

FOREIGN PATENT DOCUMENTS

JP 2011-184068 9/2011
JP 2013241190 * 5/2012
(Continued)

OTHER PUBLICATIONS

Extended European Search Report for 15847118.5 dated Jun. 2, 2017.
(Continued)

*Primary Examiner* — Timothy R Waggoner
*Assistant Examiner* — Ayodeji T Ojofeitimi
(74) *Attorney, Agent, or Firm* — IPUSA, PLLC

(57) ABSTRACT

The length of a projection of a household tissue is suppressed without hampering the removal of household tissues situated at a depth under a frame member. The frame member (14) is attached to the perimeter of the dispensing opening (11). The frame member is made of elastic material. The opposite ends of the frame member in the short-side direction of the casing (10) in a plan view have restricting portions (14*b*) that extend in such directions as to cover the dispensing opening (11). The restricting portions (14*b*, 14*b*) are arranged so as not to overlap each other such that the tips thereof are staggered in the long-side direction of the casing in a plan view, thereby forming a letter-Z shaped cut in the frame member.

8 Claims, 11 Drawing Sheets

(51) Int. Cl.
*A47K 10/20* (2006.01)
*A47K 10/32* (2006.01)

(52) U.S. Cl.
CPC .. *B65D 83/0894* (2013.01); *A47K 2010/3266* (2013.01)

(58) Field of Classification Search
USPC ..... 221/197, 31–63; 220/521
See application file for complete search history.

(56) References Cited

FOREIGN PATENT DOCUMENTS

| | | |
|---|---|---|
| JP | 2013-241190 | 12/2013 |
| JP | 2013-256322 | 12/2013 |
| WO | 2012/085699 | 6/2012 |

OTHER PUBLICATIONS

Japanese Office Action for 2014-201106 dated Apr. 4, 2017.
International Search Report for PCT/JP2015/077579 dated Nov. 24, 2015.

* cited by examiner

HOUSEHOLD TISSUE CASE

TECHNICAL FIELD

The present invention relates to a household tissue case for storing household tissues.

BACKGROUND ART

Conventionally, household tissue cases for storing household tissues that are used for wiping a house floor, a toilet, a human body, etc. are known in the art.

A typical configuration of such a household tissue case has a lid at the upper face of the case for storing household tissues, and the lid is opened and closed by vertically rotating its open end. In such a configuration, however, the opened lid is placed in the upright position, which requires a certain height for opening the lid, thereby resulting in a problem of inconvenience of use in a narrow space. Further, the upright position of the opened lid in this configuration gives rise to a problem in that pulling out tissues from the backside of the lid is difficult because the lid obstructs the way.

In contrast, the configuration using a lid that is opened and closed through sliding movement (see Patent Document 1, for example) does not cause the opened lid to be in the upright position, and is thus easy to use in a narrow space. Such a configuration also allows house-hold tissues to be pulled out from any directions because of the non-obstructive nature of the lid.

The household tissue case as described above has a frame member attached to the perimeter of the opening for dispensing household tissues, which allows the household tissues to pass through the frame member from the lower side to the upper side for removal of the household tissues.

RELATED-ART DOCUMENTS

Patent Document

Patent Document 1: Japanese Patent Application Publication No. 2013-256322

SUMMARY OF THE INVENTION

Problem to be Solved by the Invention

In the configuration disclosed in Patent Document 1, the frame member covers the perimeter of the dispensing opening, so that removing a household tissue through the frame member having a wide opening causes a next household tissue to stick out to an excessive extent. This gives rise to a problem in that closing an upper lid 20 ends up jamming the household tissue.

It is conceivable to use a lid member having a small area size opening. Such a configuration, however, creates a problem in that it becomes difficult to pick and pull out a household tissue situated deep under the frame member.

It is an object of the present invention to provide a household tissue case that can suppress the length of a projection of a household tissue without hampering the removal of household tissues situated at a depth under the frame member.

Means to Solve the Problem

In order to achieve the above-noted object, the invention recited in claim 1 includes:

a casing having a dispensing opening in an upper face thereof and configured to store household tissues therein; and a lid configured to open and close the dispensing opening, wherein a frame member is attached to a perimeter of the dispensing opening, the frame member being made of an elastic member, restricting portions being disposed at opposite ends of the frame member in a short-side direction of the casing in a plan view and extending in such a directions as to cover the dispensing opening, and the restricting portions being arranged to avoid overlapping each other such that tips thereof are staggered in a long-side direction of the casing in a plan view, thereby forming a letter-Z-shaped cut in the frame member.

The invention recited in claim 2 is characterized in that, in the household tissue case recited in claim 1, the dispensing opening is situated off a center of gravity of the household tissue case in a plan view when the lid is in an open position, and the frame member has a projection disposed on the same side as the center of gravity and extending in such a direction as to cover the dispensing opening such as not to overlap the restricting portions.

The invention recited in claim 3 is characterized in that, in the household tissue case recited in claim 1 or 2, the household tissues are folded and stored in the casing, and a fold direction of the household tissues is parallel to the long-side direction of the casing in a plan view.

The invention recited in claim 4 is characterized in that, in the household tissue case recited in any one of claims 1 to 3, the frame member is made of elastomer resin.

The invention recited in claim 5 is characterized in that, in the household tissue case recited in any one of claims 1 to 4, the lid is slid relative to the casing to open and close the dispensing opening.

Advantage of the Invention

According to the present invention, the length of a projection of a household tissue can be suppressed without hampering the removal of household tissues situated at a depth under the frame member.

MODE FOR CARRYING OUT THE INVENTION

In the following, embodiments of the present invention will be described with reference to the accompanying drawings. It should be noted that the scope of the invention is not limited to the illustrated examples.

<Configuration of Household Tissue Case>

In the following, a description will be given of the configuration of a household tissue case according to the present embodiment.

In the following description, the long-side direction in a plan view of the household tissue case is referred to as a left and right direction, and the short-side direction in the plan view is referred to as a front and rear direction, with the height direction being referred to as a vertical direction.

Figure 1A:
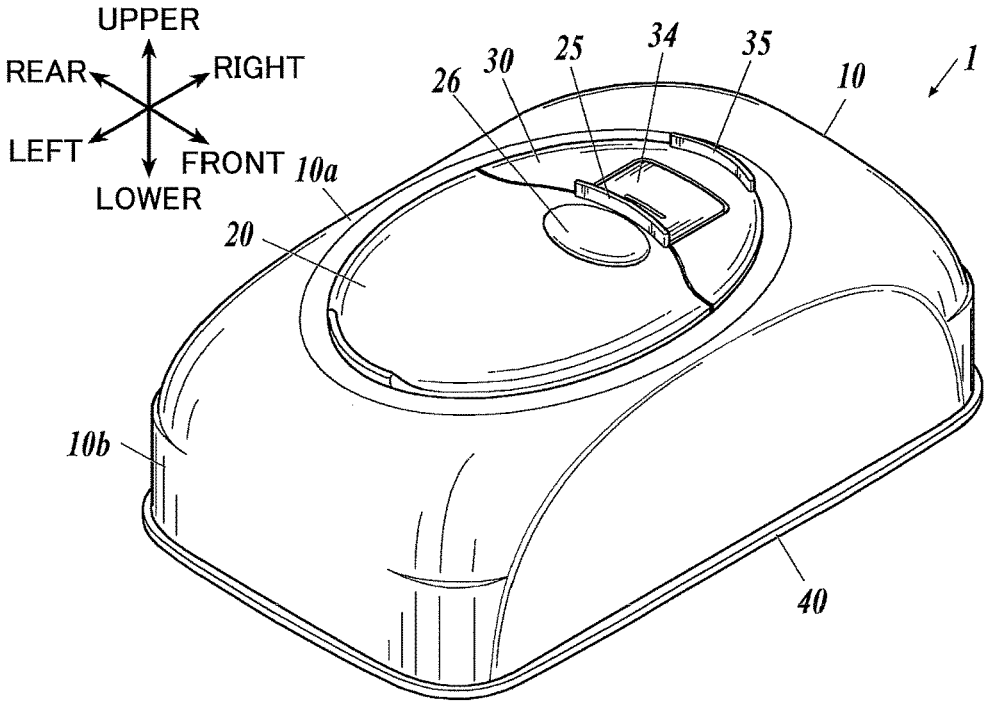
FIG. 1A is an axonometric view illustrating a household tissue case according to an embodiment of the present invention as appears when an upper lid is closed.

A household tissue case 1 of the present embodiment has an approximately rectangular shape having rounded upper corners in a side elevation view taken in the front and rear direction when an upper lid 20 is closed as shown in FIG. 1A, for example. The household tissue case 1 is configured to store therein wet-type household tissues P such as wet sheets, wet tissues, etc. The household tissue case 1 may store dry-type household tissues P such as facial tissues, kitchen papers, paper towels, etc.

Specifically, the household tissue case 1 includes, as illustrated in FIG. 1 through FIG. 5, for example, a dispensing opening 11 in the upper face thereof for dispensing the household tissues P, a bottom opening 12 in the lower face thereof for replenishing a tissue stack Q that is a stack of the household tissues P, a casing 10 for storing the tissue stack Q inside a container space S, the upper lid 20 disposed at the upper face of the casing 10 in a slidable manner for opening and closing the dispensing opening 11, a chassis 30 for mounting the upper lid 20 to the casing 10, a bottom lid 40 for covering the bottom opening 12 of the casing 10, urging members 50 for urging the upper lid 20 toward the open position, etc.

The casing 10 and the chassis 30 serve as a case unit having the dispensing opening 11 in the upper face thereof for storing therein the household tissues P. Namely, the case unit includes the casing 10 and the chassis 30 fastened to the upper face of the casing 10, with the upper lid 20 being mounted to the chassis 30 of the case unit.

The casing 10, the upper lid 20, the chassis 30, and the bottom lid 40 are made of thermoplastic resin such as PP (polypropylene), PE (polyethylene), PVC (polyvinyl chloride), PET (polyethylene terephthalate), and ABS (acrylonitrile butadiene styrene).

The present embodiment uses an extension coil spring (pull spring) as the urging member 50. This is, however, only a non-limiting example. The urging member 50 may alternately be implemented by use of any elastic member, and may be a torsion spring, a helical compression spring (push spring), or the like.

The urging member 50 may be an elastic member made of metal material or an elastic member made of polymer material. Elastic members made of polymer material include, for example, an elastic member made of plastic and an elastic member made of elastic body (soft material) such as rubber like silicon rubber or thermoplastic elastomer such as styrene, olefin, vinyl chloride, polyester, polyurethane, or nylon elastomer. The shape may be a helical shape, a blade shape, a tube shape, or a string shape, and may be modified as appropriate. The urging member 50 made of polymer material does not rust unlike an urging member made of metal, and thus can be reliably used for a long time. Especially when the household tissues P stored in the household tissue case 1 is a wet type, the use of the urging member 50 made of metal results in consequences in which the possibility of the urging member being rusted increases due to chemical solution evaporating from the household tissues P. Because of this, the use of the urging member 50 made of polymer material is preferable.

The upper lid 20 is opened and closed through sliding movements in the left and right direction (i.e., in the long-side direction in the plan view of the casing 10). Namely, the upper lid 20 is slid from the closed-state position to one side in the left and right direction (to the left-hand side in the present embodiment) to be opened, and is slid from the open-state position to the other side in the left and right direction (to the right-hand side in the present embodiment) to be closed. The household tissue case 1 is configured such that upon the upper lid 20 being slid toward the open-state position (to the left), one side of the household tissue case 1 in the left and right direction (i.e., left-hand side in the present embodiment) becomes heavier than the other side of the household tissue case 1 in the left and right direction (i.e., right-hand side in the present embodiment). Further, the dispensing opening 11 is situated off the center of gravity of the household tissue case 1 in the plan view with the upper lid 20 being in the open position (i.e., deviated to the right in the present embodiment).

Hereinafter, the center of gravity of the household tissue case 1 with the upper lid 20 being at the open position is referred to as an "open gravity center".

The tissue stack Q is a stack of tissues used as a refill having a stack of the household tissues P, for example. Tissues are interfolded to form a stack such that the household tissues P can be pulled out one after another through the dispensing opening 11 formed in the case unit (i.e., the casing 10 in the example of the present embodiment). Namely, the popup configuration is used such that pulling one of the household tissues P out of the case unit through the dispensing opening 11 causes a tip of the next one of the household tissues P to be pulled out from the container space S to stick out from the dispensing opening 11.

The tissue stack Q may be enclosed in an enclosure T having an opening T1 for pulling out the household tissues P as in the present embodiment, or may alternately be not enclosed in the enclosure T. Especially when the household tissues P stored in the household tissue case 1 is a wet type as in the present embodiment, it is preferable to enclose the tissue stack Q with the moisture-proof enclosure T.

Figure 1B:
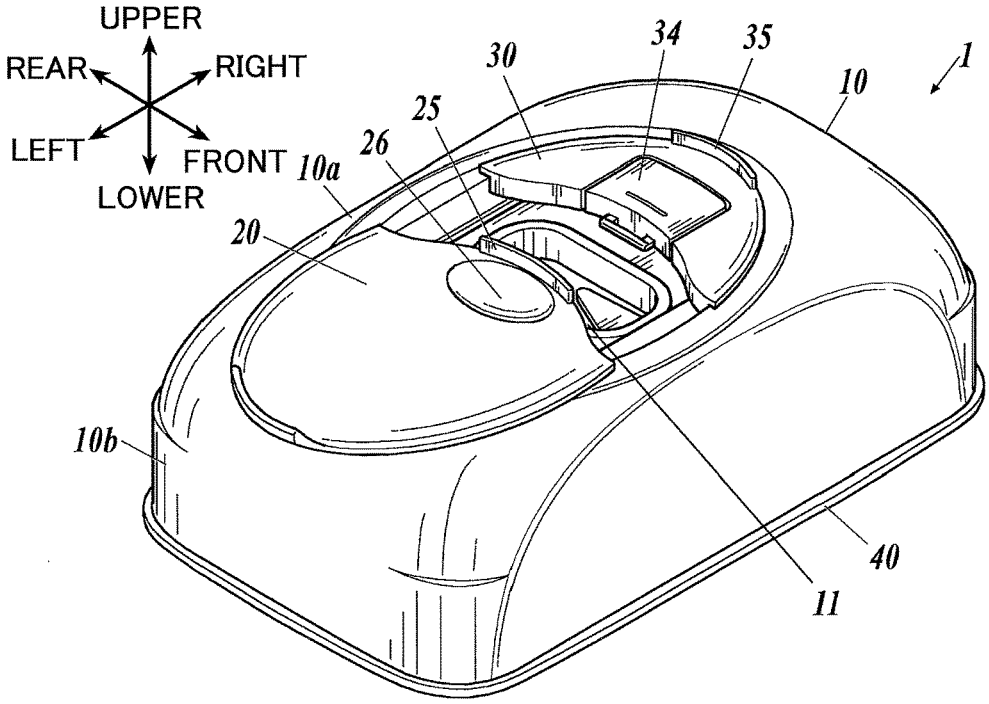
FIG. 1B is an axonometric view illustrating the household tissue case according to the embodiment of the present invention as appears when the upper lid is open.

As illustrated in FIG. 1A and FIG. 1B, for example, the casing 10 has an upper face 10*a* constituting the upper surface of the casing 10 and circumferential faces 10*b* constituting the circumferential surface at the front, rear, left, and right side of the casing 10. The lower face of the casing 10 has the bottom opening 12 having a rectangular shape with rounded corners in the plan view. The space enclosed by the upper face 10*a* and circumferential faces 10*b* of the casing 10 and the bottom lid 40 that is attached to cover the bottom opening 12 serves as the container space S for storing the tissue stack Q.

Although the present embodiment uses the casing 10 having an opening at the lower face such that the tissue stack Q can be replenished from the lower-face side, this is not a limiting example. For example, a casing 10 having a covered lower face with an opening in one of the front, rear, left, and right faces may be used, such that the tissue stack Q is replenished through one of the front, rear, left, and right faces of the casing 10.

The upper face 10*a* of the casing 10 has a recess 13 that has a lowered surface. A bottom surface 13*a* of the recess 13 has the dispensing opening 11 formed therein.

The dispensing opening 11 is an approximately rectangular opening having round corners in a plan view for pulling out the household tissues P stored in the container space S inside the casing 10.

Figure 3:
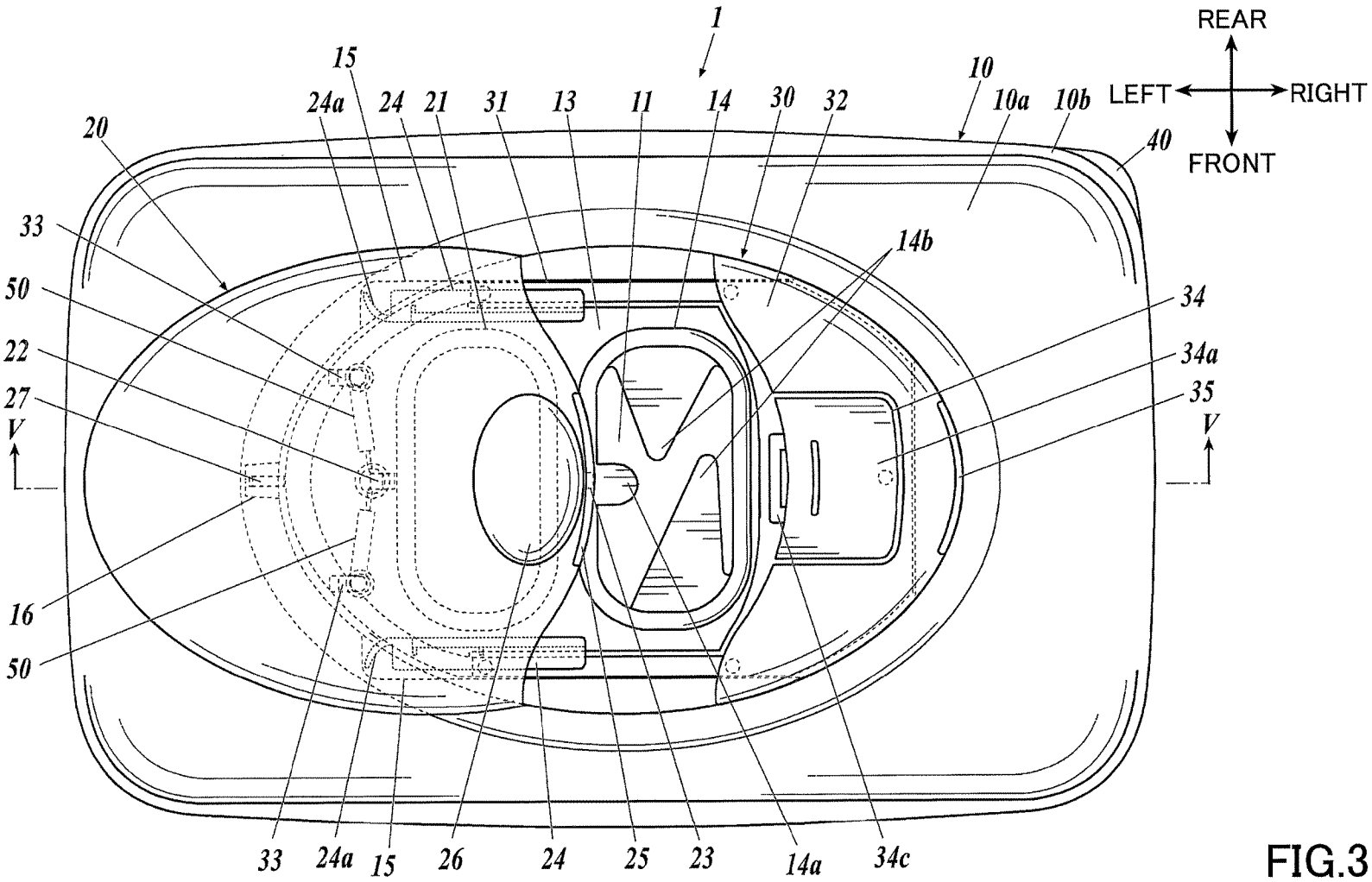
FIG. 3 is a plan view illustrating the household tissue case according to the embodiment of the present invention as appears when the upper lid is open.
Figure 5:
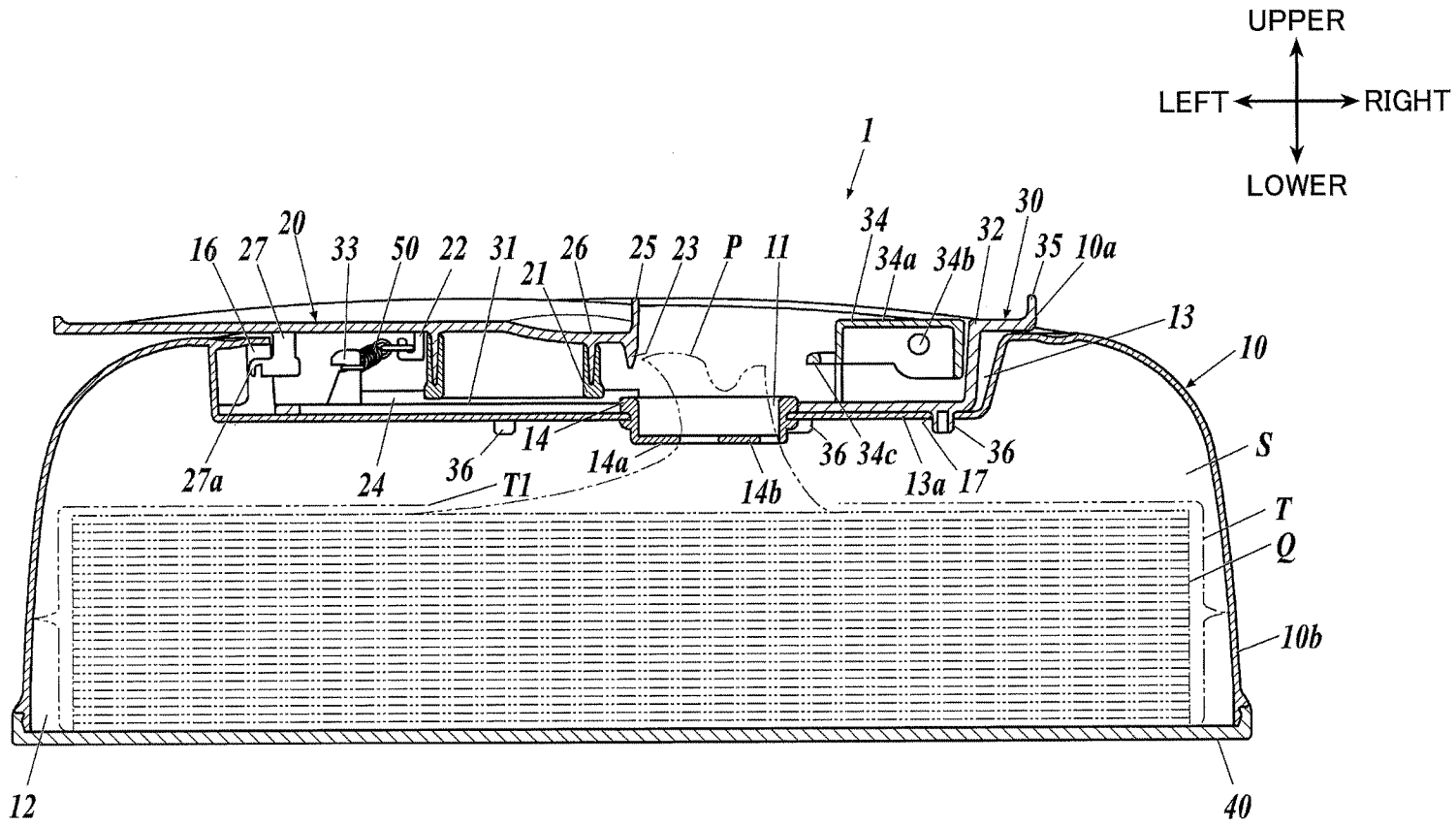
FIG. 5 is a cross-sectional view of the household tissue case taken along a line V-V in FIG. 3.

The dispensing opening 11 is exposed when the upper lid 20 is at the open position (see FIG. 1B, FIG. 3, and FIG. 5). In such a state, the household tissues P can be pulled out one after another from the container space S through the dispensing opening 11.

Figure 2:
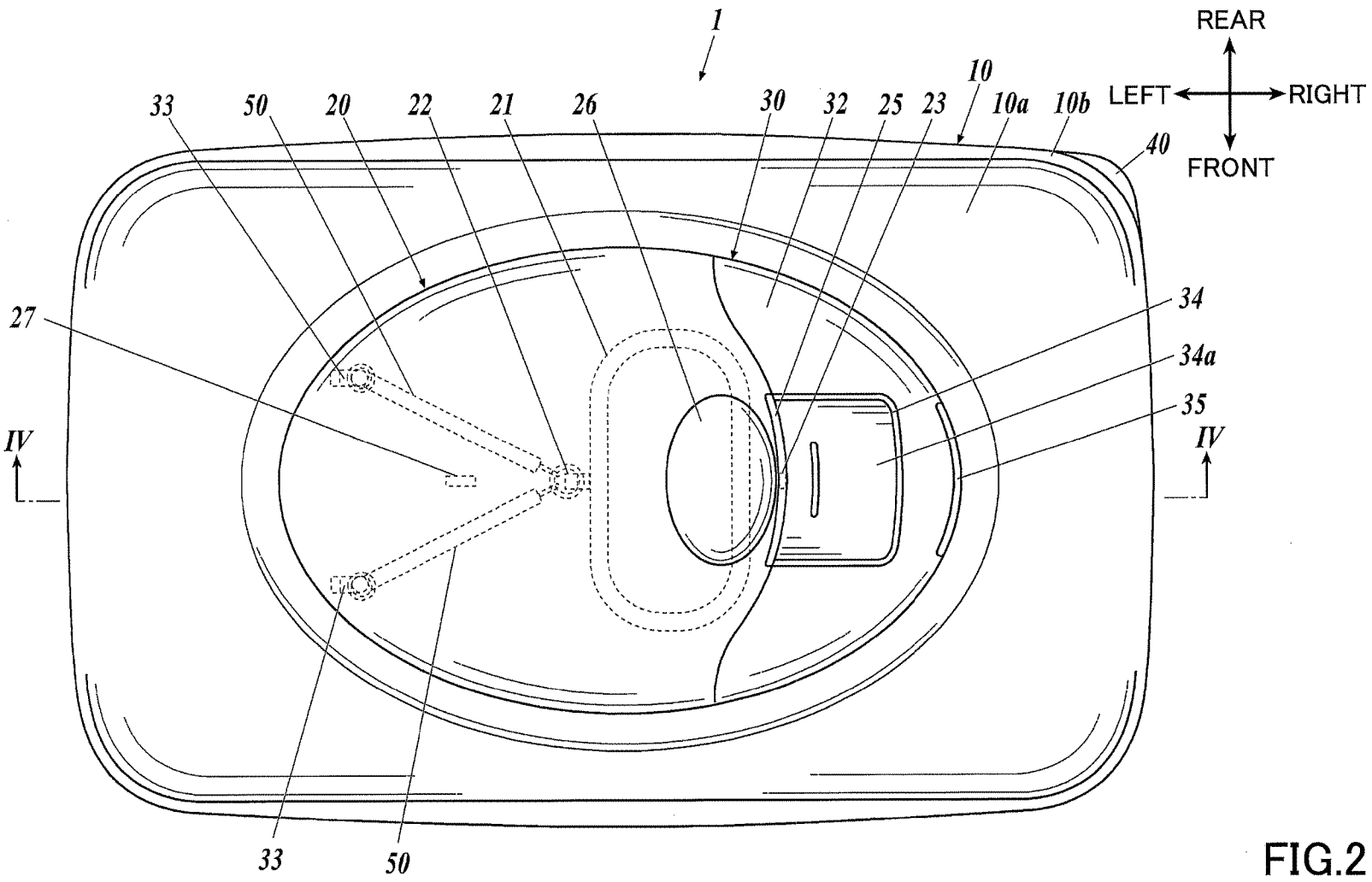
FIG. 2 is a plan view illustrating the household tissue case according to the embodiment of the present invention as appears when the upper lid is closed.
Figure 4:
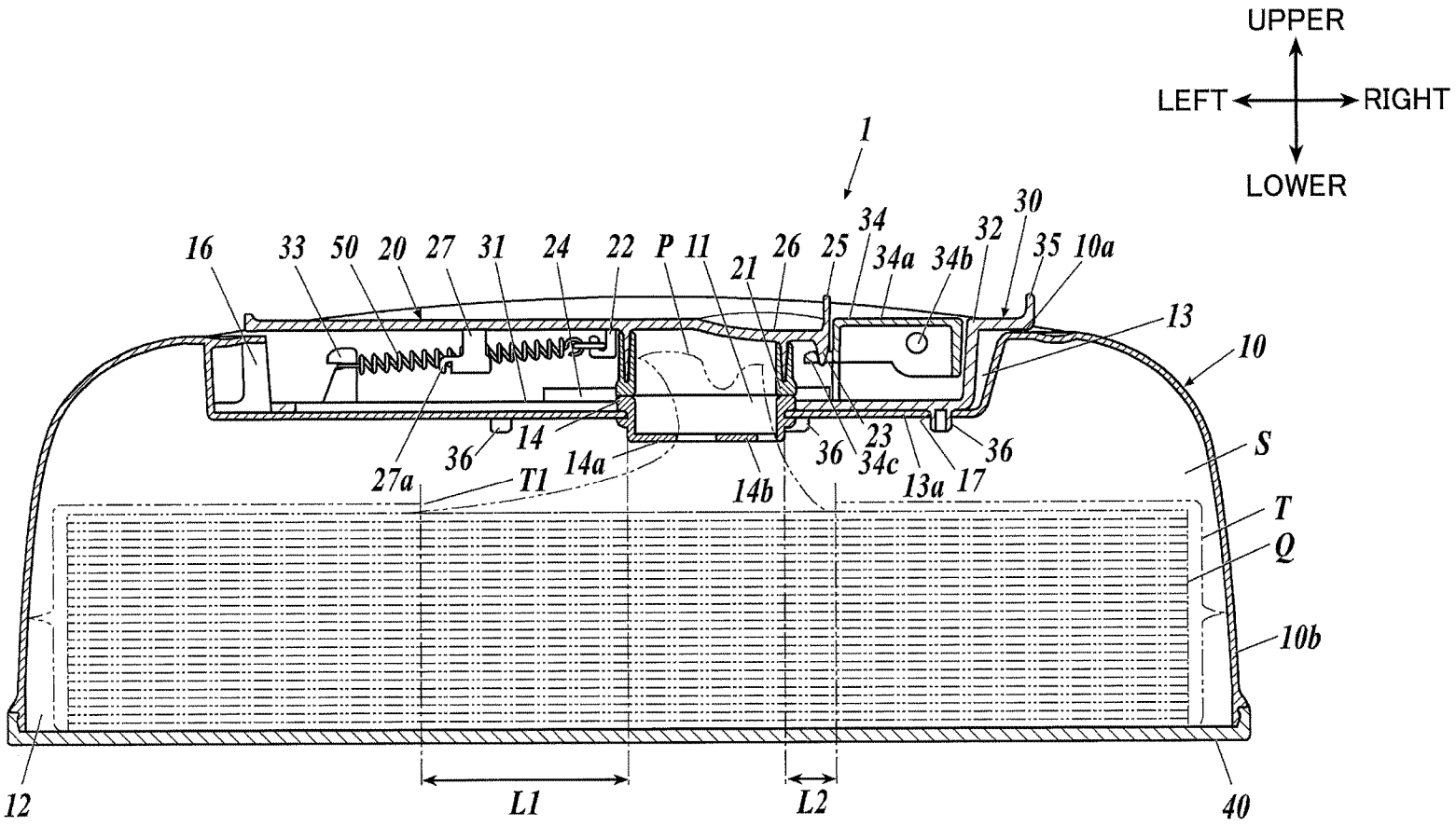
FIG. 4 is a cross-sectional view of the household tissue case taken along a line IV-IV in FIG. 2.

Further, the dispensing opening 11 is covered when the upper lid 20 is at the closed position (see FIG. 1A, FIG. 2, and FIG. 4).

As illustrated in FIG. 4 and FIG. 5, for example, the perimeter of the dispensing opening 11 has a case-side packing 14 attached thereto. Namely, the case-side packing 14 serves as a frame member mounted to the perimeter of the dispensing opening 11.

Moreover, the lower face of the upper lid 20 has a lid-side packing 21 attached thereto.

The lid-side packing 21 is situated beneath the lower face of the upper lid 20 at such a position to face the case-side packing 14 when the upper lid 20 is at the closed position. The case-side packing 14 and the lid-side packing 21 are in close contact with each other when the upper lid 20 is at the closed position (see FIG. 4) to maintain airtightness in the container space S. Namely, the case-side packing 14 and the lid-side packing 21 serve as an airtight means for sealing the gap between the upper lid 20 and the perimeter of the dispensing opening 11.

This configuration serves to prevent evaporation of the chemical solution contained in the household tissues P when the household tissues P stored in the household tissue case 1 is a wet type as in the case of the present embodiment.

In the present embodiment, the case-side packing 14 and the lid-side packing 21 are made of soft material (elastic member) such as rubber like silicon rubber or thermoplastic elastomer such as styrene, olefin, vinyl chloride, polyester, polyurethane, or nylon elastomer or the like. The material that makes the lid-side packing 21 is not limited to these. The lid-side packing 21 may be made of LDPE (low density polyethylene), or may be made of hard material such as PE (polyethylene) or PP (polypropylene). The lid-side packing 21 may be made of the same material as the case-side packing 14, or may be made of a different material. The case-side packing 14 and the lid-side packing 21 are preferably made of a material having tolerance to chemical solution, especially when the household tissues P stored in the household tissue case 1 is a wet type.

The present embodiment has the case-side packing 14 on the casing 10 and the lid-side packing 21 on the upper lid 20. Namely, both the casing 10 and the upper lid 20 are provided with an airtight means. This is not a limiting example. An airtight means may be provided only on the casing 10, for example, if such an airtight means is capable of sealing the gap between the upper lid 20 and the perimeter of the dispensing opening 11. Further, an airtight means may be provided on the chassis 30 when the dispensing opening 11 is formed in the chassis 30.

In the case of the present embodiment, the fold direction of the household tissues P stored in the container space S, i.e., the direction in which the hold lines extend, is parallel to the left and right direction (i.e., the long-side direction of the casing 10 in the plan view).

Further, the longitudinal direction of the dispensing opening 11 is perpendicular to the left and right direction (i.e., the long-side direction of the casing 10 in the plan view).

Accordingly, the household tissues P, when pulled out through the dispensing opening 11, come in contact with the long sides of the case-side packing 14 (i.e., the portion of the case-side packing 14 that is perpendicular to the fold direction of the household tissues P stored in the container space S) rather than come in contact with the short sides of the case-side packing 14 mounted to the dispensing opening 11 (i.e., the portion of the case-side packing 14 that is parallel to the fold direction of the household tissues P stored in the container space S).

The lower end of the case-side packing 14 projects further downwardly than the dispensing opening 11 (i.e., toward the tissue stack Q stored in the container space S) as illustrated in FIG. 4 and FIG. 5, for example. Accordingly, the lower end of the case-side packing 14 comes in contact with the uppermost one of the household tissues P and the next one of the household tissues P when the uppermost one of the household tissues P is pulled out, thereby serving as resistance against the uppermost one of the household tissues P and the next one of the household tissues P. This prevents the next one of the household tissues P from sticking out and having an excessively long exposed length (i.e., the length thereof projecting from the dispensing opening 11), and also prevents plural sheets of the household tissues P from dragged out in one sequence. Namely, the case-side packing 14 serves to impede the household tissues P such that the household tissues P are not dispensed uselessly.

Figure 6A:
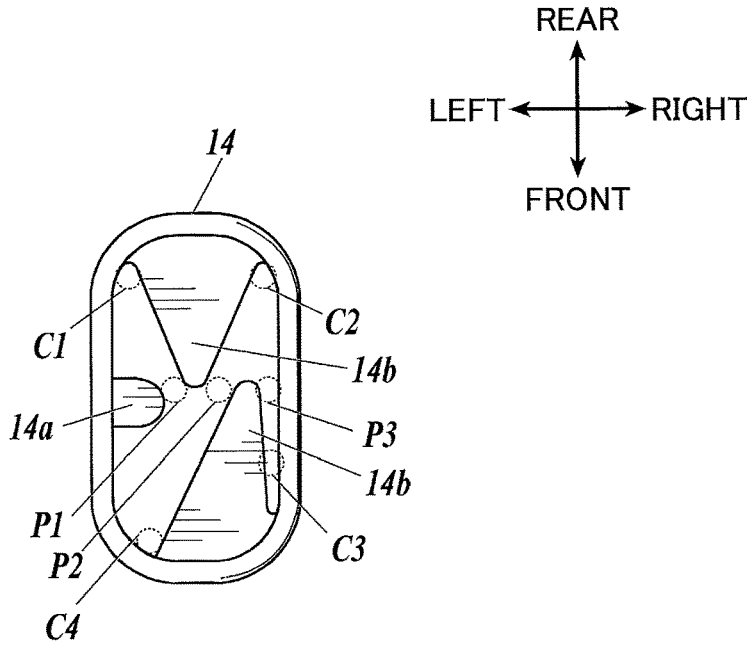
FIG. 6A is a plan view illustrating a case-side packing.
Figure 6B:
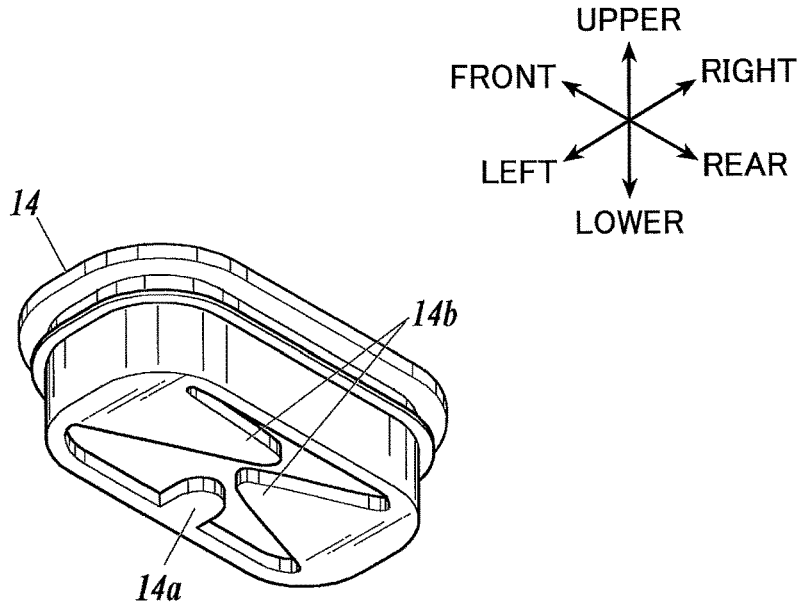
FIG. 6B is an axonometric view illustrating the case-side packing.

The left-side portion of the lower end of the case-side packing 14 (i.e., the portion situated toward the open gravity center) has a projection 14*a* projecting in an arc shape toward the inside (i.e., in such a direction as to cover the dispensing opening 11) as illustrated in FIG. 6A and FIG. 6B, for example.

Moreover, the opposite ends of the lower end of the case-side packing 14 in the front and rear direction have restricting portions 14*b*, respectively, projecting in such a direction as to cover the dispensing opening 11 (in the front and rear direction) as illustrated in FIG. 6A and FIG. 6B, for example. Namely, the lower end of the case-side packing 14 has cuts C1 through C4 formed therein, such that the two restricting portions 14*b* and 14*b* are separated from the opposite ends in the left and right direction. Further, the restricting portions 14*b* and 14*b* are arranged such that the tips are staggered in the left and right direction such as to prevent overlapping with each other.

The provision of a pair of the restricting portions 14*b* and 14*b* as described above serves to create a letter-z shaped cut in the case-side packing 14. It should be noted that the term "letter-z shape" includes a reversed letter-z shape that is a letter-z shape reversed in the left and right direction.

Hold parts P1 through P3 formed by the projection 14*a* and the pair of restricting portions 14*b* and 14*b* hold the household tissues P, so that the household tissues P do not stick out excessively when the household tissues P are pulled out.

At least one of the case-side packing 14 and the lid-side packing 21 has a slip agent applied thereto. Application of the slip agent to at least one of the case-side packing 14 and the lid-side packing 21 allows the upper lid 20 to be smoothly slid.

Figure 7:
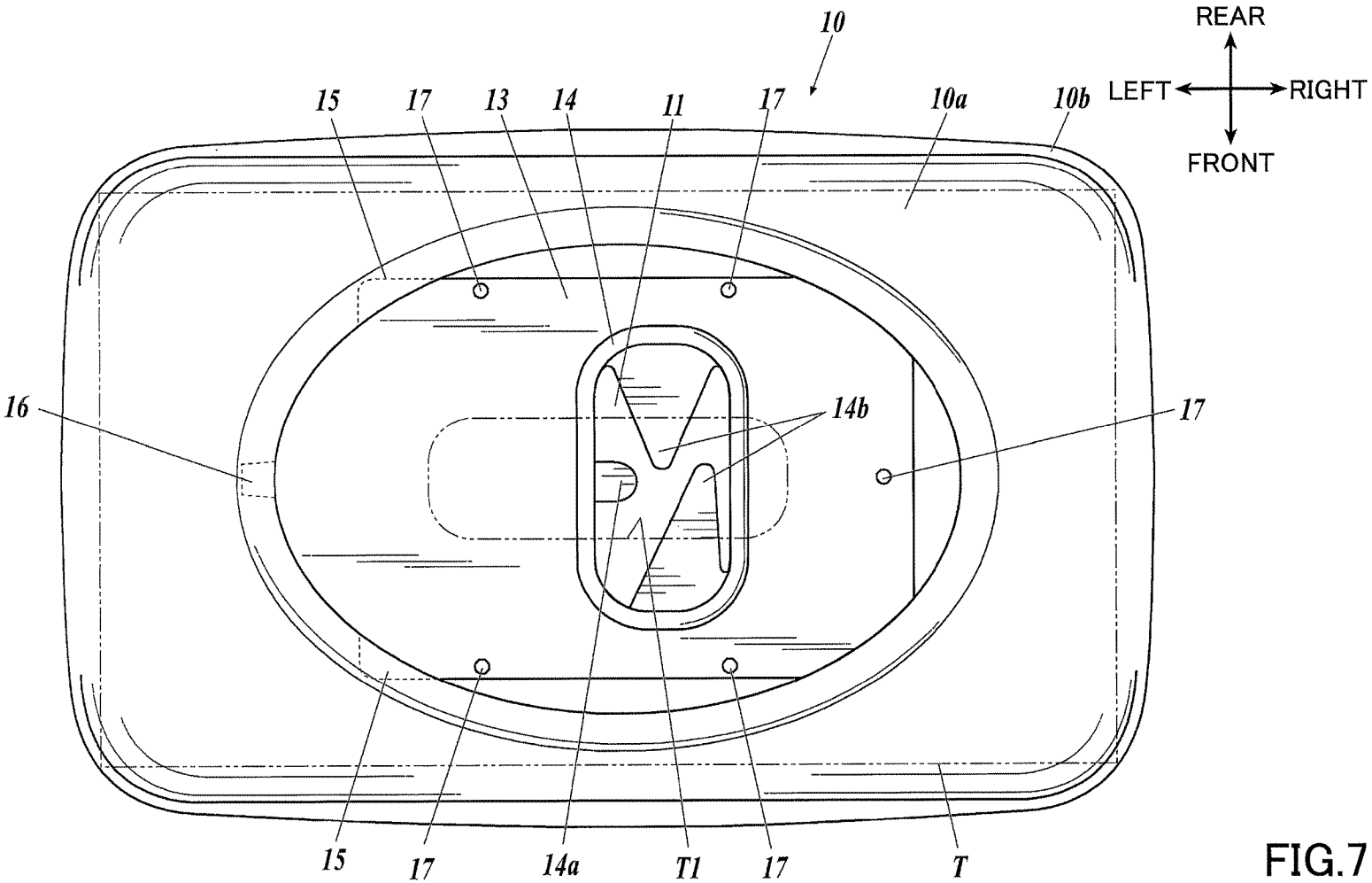
FIG. 7 is a plan view illustrating a casing.

In the case of the present embodiment, as illustrated in FIG. 7, for example, the dispensing opening 11 is displaced relative to the opening T1 of the enclosure T in a plan view. Also, the center of the dispensing opening 11 is situated further to the right (i.e., in the opposite direction from the open gravity center) relative to the center of the opening T1 of the enclosure T.

Namely, as illustrated in FIG. 4, for example, a distance L1 from the left-side end of the opening T1 (i.e., the left-side end of the opening T1 along the longitudinal axis) to the left-side end of the dispensing opening 11 is longer than a distance L2 from the right-side end of the opening T1 (i.e., the right-side end of the opening T1 along the longitudinal axis) to the right-side end of the dispensing opening 11.

The chassis 30 is fastened to the upper face 10*a* of the casing 10 such as to be accommodated in the recess 13 of the casing 10. The upper lid 20 is mounted to the casing 10 via the chassis 30.

Figure 8:
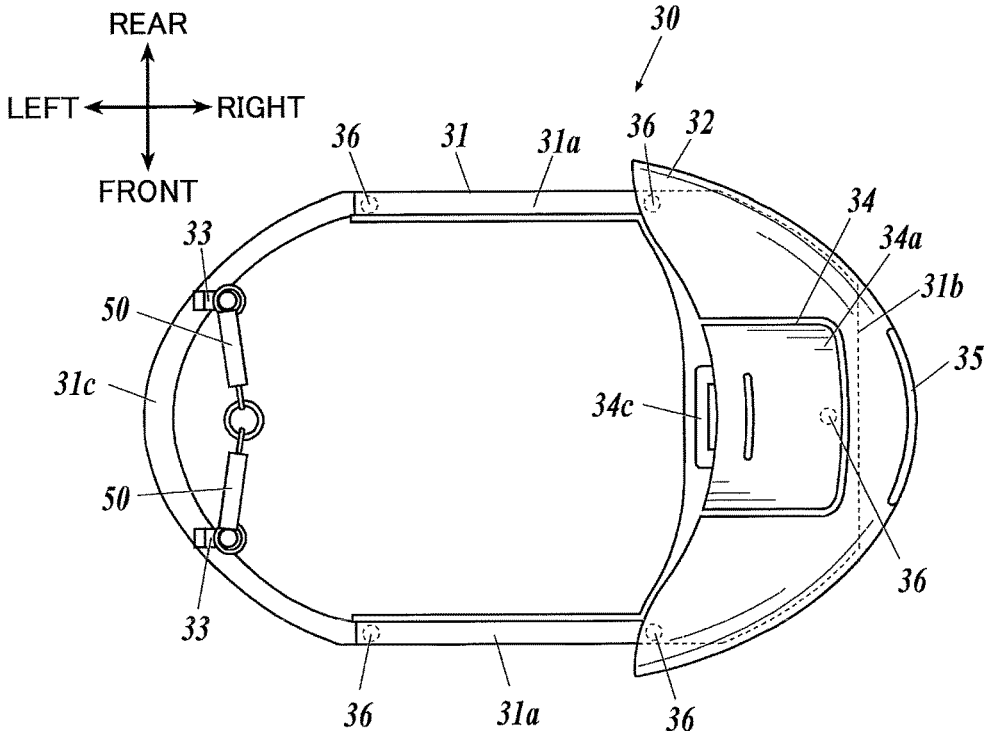
FIG. 8 is a plan view illustrating a chassis and urging members.

As illustrated in FIG. 8, for example, the chassis 30, which is placed at the bottom surface 13*a* of the recess 13, includes a frame 31 surrounding the dispensing opening 11 and an upper wall unit 32 supported on the frame 31 such as to be flush with the upper lid 20 in the closed position.

In the present embodiment, the upper lid 20 and the upper wall unit 32 together constitute a plate member that is approximately elliptical in a plan view. Further, the upper lid 20 and the upper wall unit 32 have a curved shape such as to bulge upward at the center in the front and rear direction (in the short-side direction).

The upper face of the frame 31 of the chassis 30 (specifically, connecting part 31*c* of the frame 31 (which will be described later)) has fixed-side engaging parts 33 that engage with one ends of the urging members 50 as illustrated in FIG. 2, FIG. 3, and FIG. 8, for example.

Figure 9:
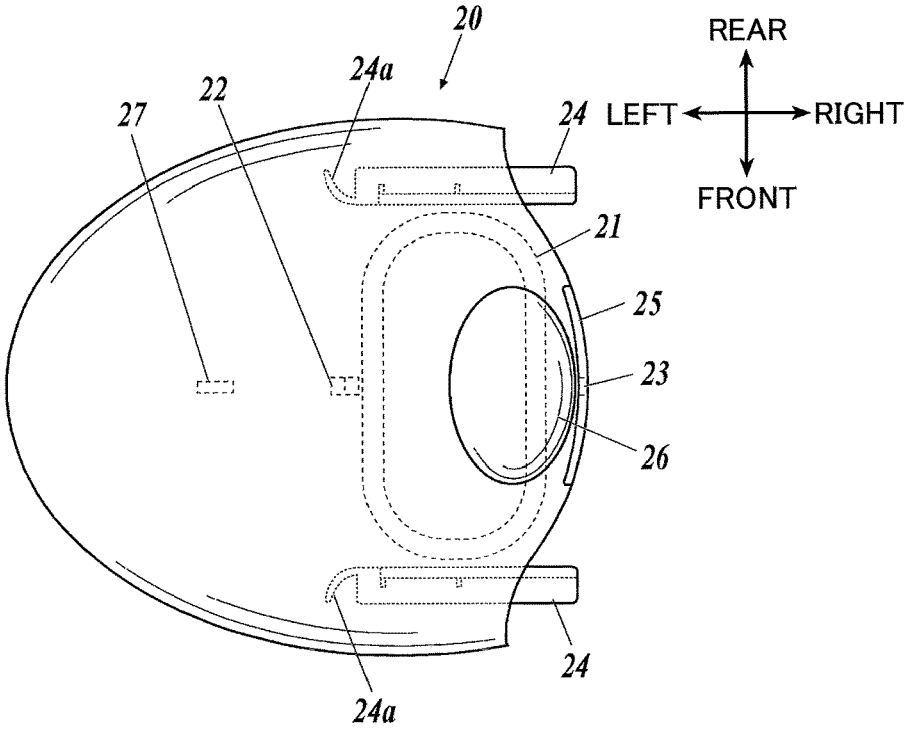
FIG. 9 is a plan view illustrating the lid.

Further, a movable-side engaging part 22 for engaging with the other ends of the urging members 50 is situated approximately at the center of the lower face of the upper lid 20 in the front and rear direction as illustrated in FIG. 2, FIG. 3, and FIG. 9, for example.

As illustrated in FIG. 8, for example, the household tissue case 1 of the present embodiment has two extension coil springs serving as the urging members 50. The frame 31 of the chassis 30 has the two fixed-side engaging parts 33. The two fixed-side engaging parts 33 are situated at the positions that are symmetric with respect to a predetermined line (specifically, the line parallel to the left and right direction (i.e., long-side direction) and passing through the movable-side engaging part 22) when the upper lid 20 and the chassis 30 are assembled. Also, the two fixed-side engaging parts are formed on the frame 31 such that their distance from the movable-side engaging part 22 in the case of the upper lid 20 being at the closed position is longer than their distance from the movable-side engaging part 22 in the case of the upper lid 20 being at the open position. One end of one of the two urging members 50 is hooked to one of the two fixed-side engaging parts 33, and one end of the other one of the two urging members 50 is hooked to the other one of the two fixed-side engaging parts 33. The other ends of the two urging members 50 are hooked to the movable-side engaging part 22 formed on the upper lid 20.

The sliding movement of the upper lid 20 to the right (i.e., toward the upper wall unit 32) from the open position to the closed position increases the distance between the fixed-side engaging parts 33 hooked to the one ends of the urging members 50 and the movable-side engaging part 22 hooked to the other ends of the urging members 50. As a result, the urging members 50 are placed in such a state as to exert an urging force to the left (i.e., toward the opposite direction from the upper wall unit 32). Namely, the urging members 50 urge the upper lid 20 towards the open position thereof when the upper lid 20 is closed. As the force acting against the urging force of the urging members 50 disappears, the urging force of the urging members 50 pulls the upper lid 20 to the left (i.e., toward the opposite direction from the upper wall unit 32), thereby exposing the dispensing opening 11.

Further, as illustrated in FIG. 4 and FIG. 5, for example, the present embodiment has the movable-side engaging part 22 situated above the fixed-side engaging parts 33. Namely, the urging members 50 are placed at an angle relative to the height direction of the case unit (i.e., the casing and the chassis 30). Specifically, the urging members 50 are placed such that the ends thereof engaged with the movable-side engaging part 22 are situated above the ends thereof engaged with the fixed-side engaging parts 33. With the upper lid 20 being at the closed position, thus, the urging members 50 not only urge the upper lid 20 toward the open position, but also urge the upper lid 20 downwardly (i.e., urge the upper lid 20 against the case unit (i.e., the casing 10 in the present embodiment)). This causes the airtight means (i.e., the case-side packing 14 and the lid-side packing 21 in the present embodiment) to tightly seal the gap between the upper lid 20 and the perimeter of the dispensing opening 11, thereby improving the airtightness of the container space S.

Conventionally, there is a household tissue case having a lid that is disposed on the upper face of the casing for storing household tissues and that is opened and closed by vertically rotating its open end. For such a case, there is a configuration known in the art that has an urging member (e.g., a hinge, torsion coil spring, or the like made of elastomer or the like) urging the lid toward the open position for the purpose of facilitating a smooth opening movement of the lid. In this type of household tissue case, the urging member urges the lid toward the open position, i.e., urges the lid in the opposite direction from the closed position, which makes it difficult to maintain airtightness. On the other hand, the present embodiment has the lid (i.e., upper lid 20) that is slid in the left and right direction to be opened and closed, and has the movable-side engaging part 22 that is situated above the fixed-side engaging parts 33 so as to place the urging members 50 at an angle relative to the height direction of the case unit. With this arrangement, the lid (i.e., upper lid 20) is not only urged toward the open position but also urged in such a direction as to be pressed against the case unit, which improves the airtightness of the container space S. This configuration reliably serves to prevent evaporation of the chemical solution contained in the household tissues P when the household tissues P stored in the household tissue case 1 is a wet type as in the case of the present embodiment.

The urging members 50 are made of an elastic member. The fixed-side engaging parts 33 of the chassis 30 function as a fixed point that is disposed on the case unit (i.e., chassis 30 in the present embodiment) and that is engaged with an end of the urging member 50. The movable-side engaging part 22 of the upper lid 20 functions as a movable point that is disposed on the upper lid 20 and that is engaged with the other end of the urging member 50.

Further, the urging member 50, the fixed-side engaging parts 33 of the chassis 30, and the movable-side engaging part 22 of the upper lid 20 function as a movement mechanism that causes the upper lid 20 to slide toward the open position.

In the present embodiment, the fixed-side engaging parts 33 (i.e., fixe point) are disposed on the chassis 30. This is not a limiting example, and the fixed-side engaging parts 33 (i.e., fixed point) may be disposed on the casing 10.

In the present embodiment, the urging members 50, the fixed-side engaging parts 33 of the chassis 30, the movable-side engaging part 22 of the upper lid 20 are placed in the recess 13 and covered from the above in the open state, in the closed state, and also in the middle of transition from the open state to the closed state. Because of this, no visual observation can be made from the outside of the household tissue case 1.

Namely, the upper lid 20 covers the urging members 50, the fixed-side engaging parts 33 of the chassis 30, and the movable-side engaging part 22 of the upper lid 20 such as to prevent any visual observation thereof from the outside regardless of the state of the upper lid 20. This arrangement improves the aesthetic appearance of the household tissue case 1, and also prevents the urging members 50, the fixed-side engaging parts 33 of the chassis 30, and the movable-side engaging part 22 of the upper lid 20 from being touched.

In the present embodiment, further, the bottom surface 13*a* of the recess 13 covers the urging members 50, the fixed-side engaging parts 33 of the chassis 30, and the movable-side engaging part 22 of the upper lid 20 such as to prevent a visual observation thereof from the inside of the casing 10 (from the direction of the container space S). This arrangement also prevents the urging members 50, the fixed-side engaging parts 33 of the chassis 30, and the movable-side engaging part 22 of the upper lid 20 from being touched from the inside of the casing 10.

As illustrated in FIG. 4 and FIG. 5, for example, the right-hand end of the upper lid 20 (i.e., the end toward the upper wall unit 32) has a click 23 projecting downwardly.

Moreover, the chassis 30 has a switch unit for which a portion of the upper wall unit 32 serves as a push pad 34*a*. The switch unit 34, which is configured to be rotatable around a rod 34*b* serving as the rotation axis and extending in the front and rear direction, has an engaging part 34*c* at the left-hand side thereof (i.e., the side toward the upper lid 20) that engages with the click 23 which comes in contact therewith from the above. Further, the switch unit 34 is urged by an urging means (not shown) in the opposite direction to the direction of rotational movement caused by a push action.

With the upper lid 20 being in the open position, a force resisting the urging force of the urging members 50 is applied to cause the sliding movement of the upper lid 20 to the right (i.e., toward the upper wall unit 32). This first causes the click 23 of the upper lid 20 to come in contact with the engaging part 34*c* of the switch unit 34. A further sliding movement of the upper lid 20 to the right causes the click 23 to push the engaging part 34*c* so as to create a resisting force against the urging force of the urging means of the switch unit 34. As a result, the switch unit 34 rotates such that the engaging part 34*c* moves downwardly. The force resisting the urging force of the urging means of the switch unit 34 disappears as the upper lid 20 is placed in the closed position. In response, the urging force of the urging means of the switch unit 34 causes the switch unit 34 to rotate such that the engaging part 34*c* returns to its original position (i.e., such that the push pad 34*a* becomes flush with the surface of the upper wall unit 32). The click thus engages with the engaging part 34*c*. With this, the upper lid 20 is maintained at the closed position.

With the click 23 and the engaging part 34*c* being engaged with each other, pressing the push pad 34*a* of the switch unit 34 to apply a resisting force against the urging force of the urging means of the switch unit 34 serves to rotate the switch unit 34, such that the engaging part 34*c* moves downwardly. As the engagement between the click 23 and the engaging part 34*c* is released in response to the rotation of the switch unit 34, the urging force of the urging members 50 causes the upper lid 20 to slide to the left (i.e., in the opposite direction from the upper wall unit 32) to reach the open position.

Namely, the click 23 and the engaging part 34*c* serve as an engagement means capable of providing, and also releasing, a hook for keeping the upper lid 20 in the closed position against the urging force of the urging members 50. In the present embodiment, the switch unit 34 that is pressed when releasing the hook of the engagement means is disposed on the chassis 30. This is not a limiting example, and the switch unit 34 may alternatively be disposed on the casing 10. In the present embodiment, part of the frame 31 of the chassis 30 serves as rails 31*a* that guide the upper lid 20 along a straight line for sliding movement. Specifically, as illustrated in FIG. 8, for example, the frame 31 of the chassis 30 includes the rails 31*a* and 31*a* extending in the left and right direction and arranged side by side in the front and rear direction, a support part 31*b* for supporting the upper wall unit 32 and for connecting the right-hand ends of the rails 31*a* and 31*a* with each other (i.e., the ends thereof situated toward the closed position of the upper lid 20), and a connection part 31*c* for connecting the left-hand ends of the rails 31*a* and 31*a* with each other (i.e. the ends thereof situated toward the open position of the upper lid 20).

Further, as illustrated in FIG. 9, for example, the upper lid 20 has slide portions 24 that are engaged with the rails 31*a* in a slidable manner. When the upper lid 20 and the chassis 30 are assembled, the lower faces of the slide portions 24 are placed in contact with the upper faces of the respective rails 31*a*. In such a manner, the slide portions 24 are connected to the lower face of vertical walls (not shown) extending downwardly from the lower face of the upper lid 20, for example.

This ensures that the upper lid 20 is opened and closed in a smooth and reliable manner.

In the present embodiment, the rails 31*a* that guide the upper lid 20 for the sliding movement thereof are disposed on the chassis 30. This is not a limiting example, and the rails 31*a* may alternatively be disposed on the casing 10. As illustrated in FIG. 9, for example, the left-hand ends of the slide portions 24 (i.e., the ends thereof situated toward the open position of the upper lid 20) have dampers 24*a* for absorbing an impact occurring at the time of the upper lid 20 moving to the open position.

Further, as illustrated in FIG. 7, for example, the perimeter of the recess 13 of the casing 10 has lateral pockets 15 at such positions as to face the left-hand ends (inclusive of the dampers 24*a*) of the slide portions 24 when the upper lid 20 is at the closed position. As the upper lid moves from the closed position to the open position, the slide portions 24 enter the lateral pockets 15. With the upper lid 20 being at the open position, the dampers 24*a* of the slide portions 24 abut the casing 10 inside the lateral pockets 15. Namely, the collision of the slide portions 24 with the casing 10 serves to stop the sliding movement of the upper lid 20 caused by the urging force of the urging members 50, with the dampers 24*a* absorbing the impact at the time of collision.

In the present embodiment, the dampers 24*a* are formed in an arching line extending from the inner side to the outer side to bulge toward the left such as to deform to absorb the impact. This is not a limiting example, and the shape of the dampers 24*a* may be modified as appropriate as long as the impact can be absorbed at the time the upper lid 20 moves to the open position.

As illustrated in FIG. 4 and FIG. 5, for example, the upper lid 20 has a movable-side touch part 25 that is dragged by a finger to close the upper lid 20. Specifically, the upper lid 20 has a projection formed as the movable-side touch part 25 that stands upright at the right-hand end of the upper lid 20 (i.e., the end situated toward the closed position of the upper lid 20). Further, the upper lid 20 has a recess formed as a downward dent in the upper surface of the upper lid 20 such that the recess serves as a finger placement part 26 on which the finger dragging the movable-side touch part 25 is placed. Moreover, a fixed-side touch part 35 is formed on the case unit (i.e., the chassis 30 in the case of the present embodiment) at the right-hand side of the engagement means (i.e., the engaging part 34*c* in the case of the present embodiment), for the purpose of being touched with a finger when closing the upper lid 20, for example. Specifically, the chassis 30 has a projection formed as the fixed-side touch part 35 that stands upright at an end of the chassis 30 (i.e., the right-hand end of the upper wall unit 32 in the case of the present embodiment).

Namely, provision is made such that when a finger is placed on the left-hand side of the movable-side touch part 25 (i.e., the opposite side to the fixed-side touch part 35) to close the upper lid 20, the casing 10 is secured, and thus prevented from moving, by placing a finger on the right-hand side of the fixed-side touch part 35 (i.e., the opposite side to the movable-side touch part 25) to exert a force to the casing 10 toward the left (i.e., the force in the opposite direction to the force applied to the upper lid 20). This arrangement allows the upper lid 20 to be closed with one hand.

In the present embodiment, the fixed-side touch part 35 is disposed on the case unit (i.e., the chassis 30 in the case of the present embodiment) and spaced apart from the switch unit 34. This arrangement prevents the finger placed on the fixed-side touch part 35 from accidentally operating the switch unit 34.

In the present embodiment, the fixed-side touch part 35 is disposed on the chassis 30. This is not a limiting example, and the fixed-side touch part 35 may be disposed on the casing 10.

As illustrated in FIG. 4 and FIG. 5, for example, the lower face of the upper lid 20 has a strip projection 27 having an approximately letter-L shape in a side elevation view taken in the front and rear direction such that the tip thereof faces toward the left (i.e., toward the open position of the upper lid 20). As illustrated in FIG. 7, for example, the perimeter of the recess 13 of the casing 10 has a lateral pocket 16 at the position that faces the tip of the strip projection 27 (inclusive of a damper 27*a* which will be described later) when the upper lid 20 is at the closed position, such that the strip projection 27 enters the lateral pocket 16 when the upper lid 20 moves from the closed position to the open position. With the upper lid 20 being at the open position, the tip of the strip projection 27 of the upper lid 20 is placed in the lateral pocket 16, which regulates the vertical movement of the strip projection 27. This arrangement prevents the left-hand side of the upper lid 20 from moving upward such that the upper lid 20 is placed at an angle.

As illustrated in FIG. 4 and FIG. 5, for example, the tip of the strip projection 27 has the damper 27*a* for absorbing an impact generated at the time the upper lid 20 reaches the open position. Provision is made such that the damper 27*a* of the strip projection 27 abuts the casing 10 inside the lateral pocket 16 when the upper lid 20 is placed at the open position. Namely, the collision of the strip projection 27 with the casing 10 serves to stop the sliding movement of the upper lid 20 caused by the urging force of the urging members 50, with the damper 27*a* absorbing the impact at the time of collision.

In the present embodiment, the damper 27*a* is formed in an arching line extending from the upper side to the lower side to bulge toward the left such as to deform to absorb the impact. This is not a limiting example, and the shape of the damper 27*a* may be modified as appropriate as long as the impact can be absorbed at the time the upper lid 20 moves to the open position.

In the present embodiment, the strip projection 27 has the damper 27*a*, and the slide portions 24 have the dampers 24*a*. Namely, both the strip projection 27 and the slide portions 24 have dampers. This is not a limiting example, and only the strip projection 27, for example, may have a damper as long as such a damper can absorb (i.e., mitigate) the impact at the time the upper lid 20 reaches the open position. Alternatively, only the slide portions 24 may have dampers, or a portion other than the strip projection 27 and the slide portions 24 may have a damper. Further, the damper may alternatively be disposed on the case unit (i.e., the casing 10 or the chassis 30) instead of the upper lid 20, or may be disposed on both the upper lid 20 and the case unit. In the case of the strip projection 27 having no damper, provision may preferably be made such that the strip projection 27 does not abut the casing 10 inside the lateral pocket 16 when the upper lid 20 is at the open position. In the case of the slide portions 24 having no dampers, provision may preferably be made such that the slide portions 24 do not abut the casing 10 inside the lateral pockets 15 when the upper lid 20 is at the open position.

The present embodiment is configured such that the lateral pockets 15 receiving the left-hand ends of the slide portions 24 are covered with the upper face 10*a* from the upper side. This is not a limiting example, and the lateral pockets 15 may be exposed to the upper side.

The strip projection 27 is provided for the purpose of preventing the upper lid 20 from being raised. It may be noted, however, the lateral pockets 15 of the present embodiment for receiving the left-hand ends of the slide portions 24 are covered with the upper face 10*a* from the upper side, so that the slide portions 24 serve to prevent the upper lid 20 from being raised. In this case, specifically, the open state of the upper lid 20 causes the left-hand ends of the slide portions 24 of the upper lid 20 to enter the lateral pockets 15 of the casing 10, which regulates the vertical movement of the slide portions 24, and thus prevents the upper lid 20 from being raised. There is thus no need to provide the strip projection 27.

<Method of Making Household Tissue Case>

Figure 10:
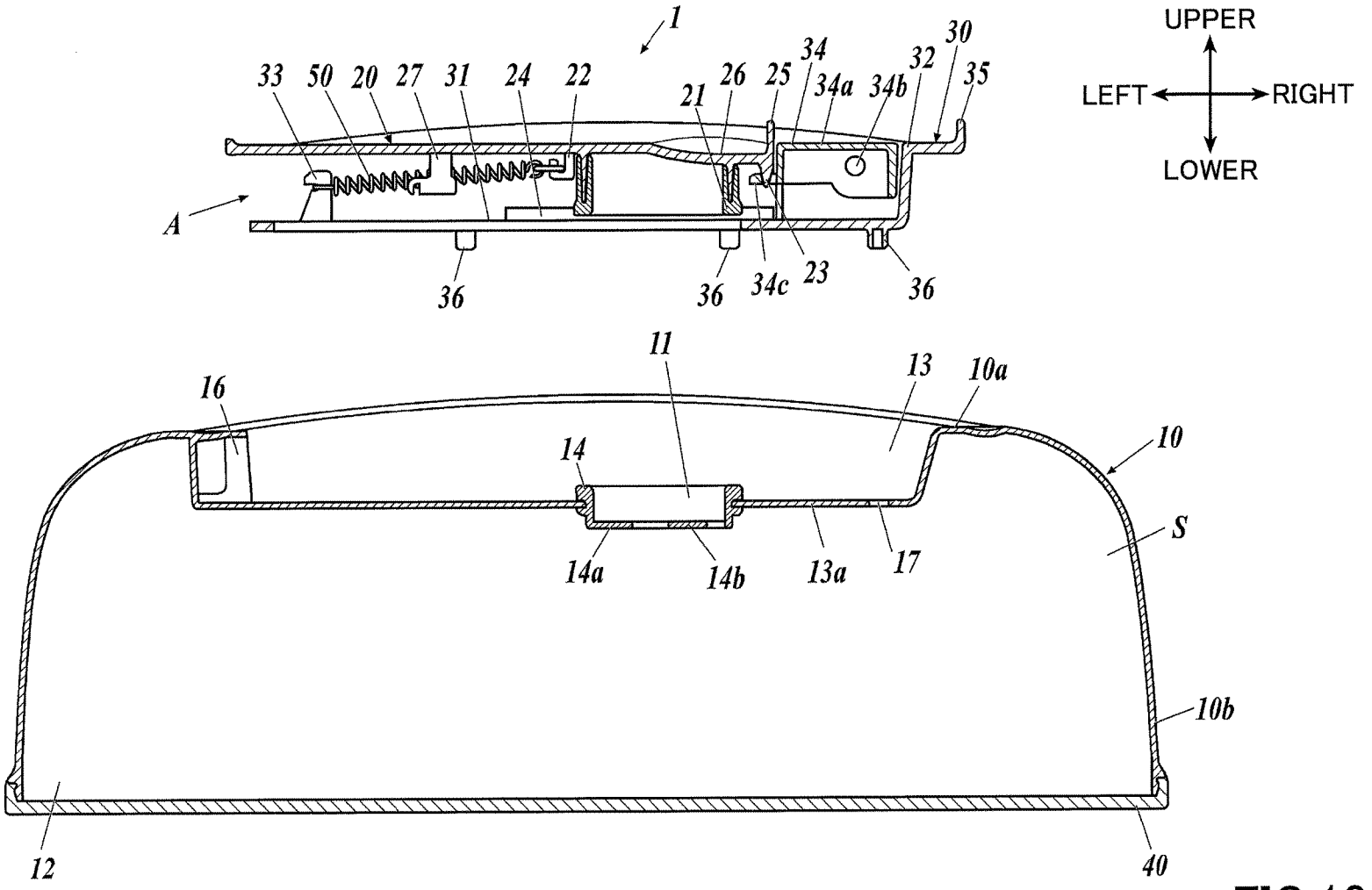
FIG. 10 is a drawing for explaining a method of making the household tissue case according to the embodiment of the present invention.

In the following, a description will be given of an example of a method of making a household tissue case of the present embodiment by referring to FIG. 10.

First, individual parts are made by a manufacturing method such as blow molding, injection, blow injection, or the like.

Next, the urging members 50 and the upper lid 20 are assembled with the chassis 30 to produce an assembled unit A.

Then, the assembled unit A is mounted to the casing 10. Specifically, the assembled unit A is fit into the recess 13 of the casing 10 from the upper side and thus mounted to the casing 10, such that engagement projections 36 (there are five of them in the present embodiment) disposed on the lower face of the chassis 30 are engaged with engagement holes 17 formed at the bottom surface 13*a* of the recess 13 of the casing 10 at the positions corresponding to the engagement projections 36. Namely, the urging members 50 and the upper lid 20 are assembled with the chassis 30 to produce the assembled unit A, which is then mounted to the casing 10. This arrangement eliminates the need for the process of mounting the upper lid 20, the urging members 50, and the chassis 30 individually to the casing 10.

In the present embodiment, the engagement projections 36 disposed on the chassis 30 are engaged with the engagement holes 17 formed in the casing 10 such as to fasten the assembled unit A to the casing 10. This is a non-limiting example, and the assembled unit A may alternatively be threadably mounted to the casing 10, for example.

EXAMPLE

<Test Result of Removal of Household Tissues>

In the following, embodiments and comparison examples will be used to describe the present invention in a more specific manner. It may be noted, however, that the present invention is not limited to these embodiments.

A test of removing household tissues P was conducted for the embodiments and comparison examples described below. The length of the household tissues P projecting from the frame member was then measured. Further, the ease of inserting and removing fingers with respect to the frame member was also measured.

In conducting such a test, household tissues P were used that had a size of 175 mm by 150 mm (with a fold width of 80 mm) and a basis weight of 34 g/m$^2$. Further, the household tissues P contained an alcohol containing chemical solution. The test was conducted under the condition that the size of the dispensing opening 11 was 39 mm by 20 mm.

Embodiment 1

The case-side packing 14 (see FIG. 6, for example) was used as the frame member attached to the perimeter of the dispensing opening 11. Elastomer resin having a hardness of 70° was used as the material of the case-side packing 14 of the first embodiment. In TABLE 1, the mouth shape of the case-side packing 14 is referred to as "A".

Embodiment 2

The case-side packing 14 (see FIG. 6, for example) was used as the frame member. Elastomer resin having a hardness of 80° was used as the material of the case-side packing 14 of the second embodiment.

The remaining conditions and test methods are the same as the first embodiment.

Embodiment 3

The case-side packing 14 (see FIG. 6, for example) was used as the frame member. Elastomer resin having a hardness of 90° was used as the material of the case-side packing 14 of the third embodiment.

The remaining conditions and test methods are the same as the first embodiment.

Comparative Example 1

A case-side packing having the same shape as the case-side packing 14 (see FIG. 6, for example) was used as the frame member. PE, which is a hard material, was used as the material of the case-side packing of the first comparative example.

The remaining conditions and test methods are the same as the first embodiment.

Comparative Example 2

Figure 11A:
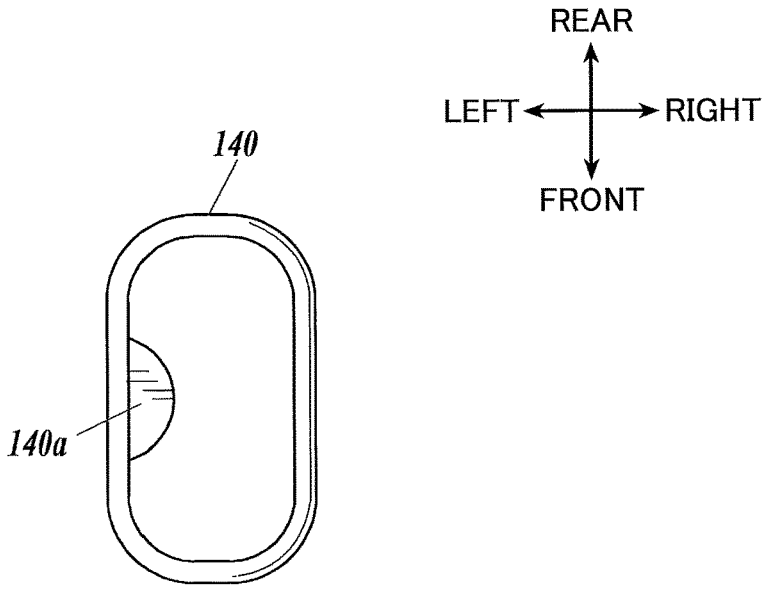
FIG. 11A is a plan view illustrating a case-side packing of a second comparative example.
Figure 11B:
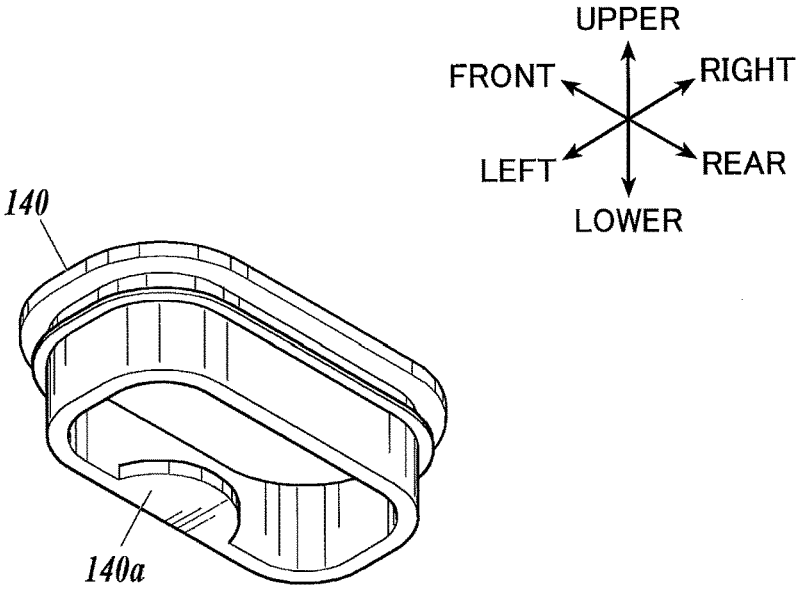
FIG. 11B is an axonometric view illustrating the case-side packing of the second comparative example.

A case-side packing 140 (see FIG. 11) having a different mouth shape than the case-side packing 14 (see FIG. 6, for example) was used as the frame member. The case-side packing 140 has an extension 140*a* formed on the left-hand side of the lower end (i.e., the portion situated toward the open gravity center) such as to extend inwardly in an arc shape as illustrated in FIG. 11A and FIG. 11B, for example. PE, which is a hard material, was used as the material of the case-side packing 140 of the second comparative example. In TABLE 1, the mouth shape of the case-side packing 140 is referred to as "C".

The remaining conditions and test methods are the same as the first embodiment.

[Test Result]

The test results of the first through third embodiments and the first and second comparative examples are illustrated in TABLE 1.

TABLE 1

| | HARDNESS | | | | |
|---|---|---|---|---|---|
| | 70° | 80° | 90° | PE | PE |
| MOUTH SHAPE | A (FIG. 6) | A | A | A | C (FIG. 11) |
| FINGER INSERTION & REMOVAL | ◎ | ◎ | ◎ | X | X |
| LENGTH OF SHEET PROJECTION | ○ | ○ | ◎ | ◎ | X |

[Evaluation of Projection of Household Tissue (Sheet) P]

◎: the length of the projection was extremely short (e.g., the tip being situated lower than the lower end of the upper lid 20), which was able to sufficiently avoid a jam at the time of closing the upper lid 20).

○: the length of the projection was short (e.g., the tip being situated at the lower end of the upper lid 20), which was able to avoid a jam at the time of closing the upper lid 20).

X: the length of the projection was long (e.g., the tip being situated above the lower end of the upper lid 20), which created difficulties in preventing a jam at the time of closing the upper lid 20).

These three grades were used for evaluation.

As illustrated in TABLE 1, the second comparative example (in which the case-side packing 140 having a large gap in the dispensing opening was used) produced a long projection due to the large gap of the dispensing opening.

On the other hand, the first embodiment (in which the case-side packing 14 having a hardness of 80° was used) and the second embodiment (in which the case-side packing 14 having a hardness of 70° was used) produced a short projection due to the small gap of the dispensing opening. Further, the third embodiment (in which the case-side packing 14 having a hardness of 90° was used) and the first comparative example (in which the case-side packing made of hard-material PE was used) produced an extremely short projection due to the small gap of the dispensing opening and the use of the hard frame member.

[Evaluation of Ease of Inserting and Removing Finger]

◎: it is easy to insert and remove fingers.

X: it is difficult to insert and remove fingers.

These two grades were used for evaluation.

As illustrated in TABLE 1, the first comparative example and the second comparative example (both of which used the case-side packing made of hard material PE) used the frame member that was hard and difficult to bend, and thus presented difficulties in inserting and removing fingers inside the frame member.

On the other hand, the first embodiment, the second embodiment, and the third embodiment (all of which used the case-side packing 14 made of soft material elastomer resin) used the frame member that was soft and easy to bend, and thus presented no difficulties in inserting and removing fingers inside the frame member.

[Comprehensive Evaluation]

As illustrated in TABLE 1, the third embodiment produced satisfactory results for all the evaluated items. The first embodiment and the second embodiment also produced satisfactory results although the result for the item "Length of Projection of Household Tissue P" was not as good as in the third embodiment.

In contrast, the first comparative example produced a problematic result for the item "Ease of Inserting and Removing Finger". The second comparative example produced problematic results for both of the items "Length of Projection of Household Tissue P" and "Ease of Inserting and Removing Finger".

It was thus established that, for the frame member, the use of the case-side packing 14 made of soft material elastomer resin was preferable, and, especially, the use of the case-side packing 14 made of elastomer resin having a hardness of 90° was the most preferable.

The household tissue case 1 of the present embodiment described heretofore has the frame member (i.e., the case-side packing 14) attached to the perimeter of the dispensing opening 11. The frame member, which is made of elastic material, has the restricting portions 14*b* disposed at the ends of the frame member in the short-side direction of the case unit (i.e., the casing 10) in a plan view to extend in such directions as to cover the dispensing opening 11. The restricting portions 14*b* and 14*b* are arranged to avoid overlapping each other such that the tips thereof are staggered in the long-side direction of the case unit in a plan view, thereby forming a letter-Z-shaped cut in the frame member.

According to the household tissue case 1 of the present embodiment, thus, the provision of the restricting portions 14*b* and 14*b* at the frame member serves to suppress the length of a projection of a household tissue without hampering the removal of household tissues placed at a depth under the frame member.

According to the household tissue case 1 of the present embodiment as described heretofore, further, the dispensing opening 11 is situated at the position off the center of gravity of the household tissue case 1 in a plan view when the lid (i.e., the upper lid 20) is at the open position. The frame member has the projection 14*a* on the same side as the center of gravity such that the projection 14*a* extends in such a direction as to close the dispensing opening 11 without overlapping the restricting portions 14*b* and 14*b*.

According to the household tissue case 1 of the present embodiment, the household tissues P pulled out through the dispensing opening 11 receive an increased resistance on the same side as the open gravity center. With this arrangement, the weight of the household tissue case 1 on the same side as the open gravity center prevents the household tissue case 1 from being raised when the household tissues P are removed.

According to the household tissue case 1 of the present embodiment as described heretofore, the household tissues P are folded and stored in the case unit, with the fold direction of the household tissues P are parallel to the long-side direction of the case unit in a plan view. Accordingly, the household tissues P upon being pulled out are likely to be dragged by the projection 14*a* and the restricting portions 14*b*, which further suppresses the length of a projection of the household tissues P. According to the household tissue case 1 of the present embodiment described heretofore, the frame member is made of elastomer resin, so that the restricting portions 14*b* and 14*b* are soft and easy to bend, thereby allowing fingers to be inserted and removed with respect to the frame member without a problem.

Further, the frame member is made of elastomer resin having a hardness of 90°, and is thus able to provide proper hardness for the restricting portions 14*b* and 14*b*. The frame member can thus significantly reduce the length of a projection of the household tissues P without hampering the insertion and removal of fingers.

Specific descriptions have been provided heretofore based on the embodiments of the present invention, but the present invention is not limited to those embodiments, and may be modified without departing from the scope of the invention.

[Variation 1]

An example illustrated in FIG. 12, for example, differs from the case-side packing 14 of the described embodiment in that the projection 14*a* extending in an arc shape is not provided.

Figure 12A:
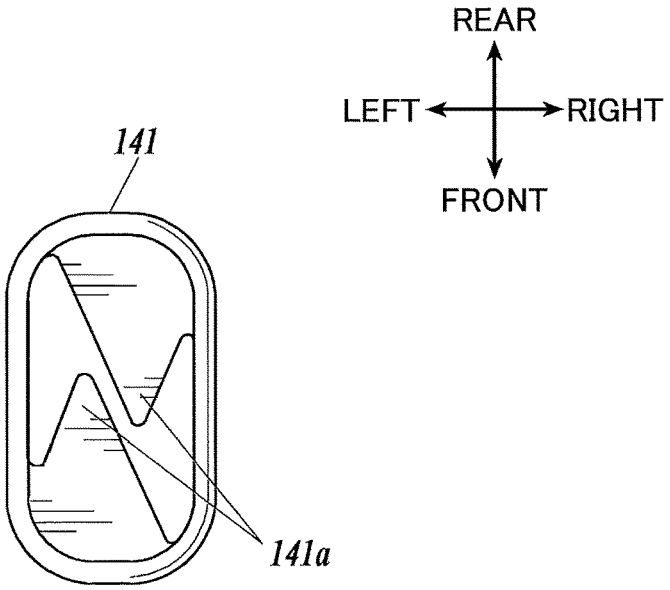
FIG. 12A is a plan view illustrating a case-side packing of a first variation.
Figure 12B:
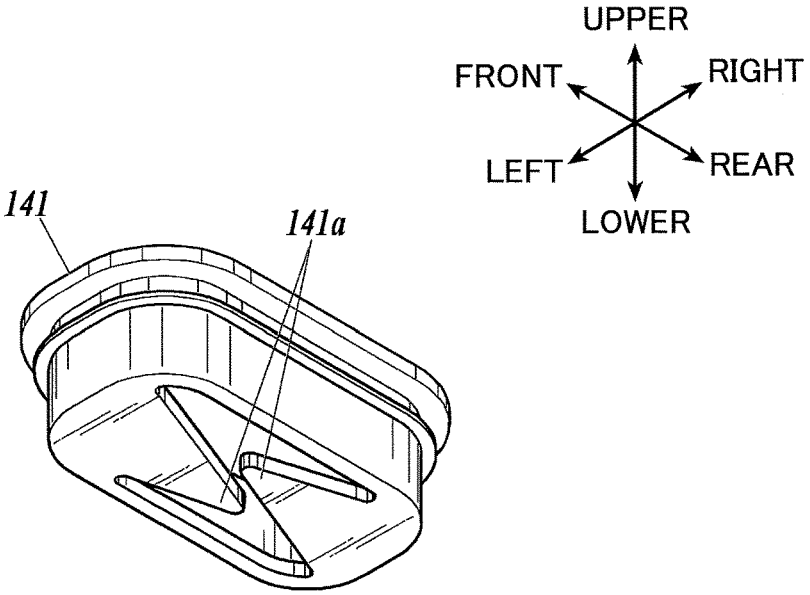
FIG. 12B is an axonometric view illustrating the case-side packing of the first variation.

Specifically, a case-side packing 141 of the first variation is made of soft material such as elastomer resin similarly to the disclosed embodiment. Moreover, the opposite ends of the lower end of the case-side packing 141 in the front and rear direction have restricting portions 141*a*, respectively, projecting in such a direction as to cover the dispensing opening 11 (in the front and rear direction) as illustrated in FIG. 12A and FIG. 12B, for example. Further, the restricting portions 141*a* and 141*a* are arranged such that the tips are staggered in the left and right direction such as to prevent overlapping with each other.

The provision of a pair of the restricting portions 141*a* and 141*a* as described above serves to create a letter-z shaped cut in the case-side packing 141.

According to the household tissue case 1 of the first variation as described above, the length of a projection of a household tissue is reduced without hampering the removal of household tissues situated at a depth under the frame member similarly to the household tissue case 1 of the disclosed embodiment.

(Other Variations)

A member may be disposed on the bottom lid 40, for example, to raise the tissue stack Q in the container space S from the lower side.

In such a case, this member and the case-side packing 14 as well as a projection Y may have the tissue stack Q placed therebetween such as to prevent the tissue stack Q from moving inside the container space S. This arrangement allows the household tissues P to be pulled out smoothly through the dispensing opening 11, and, also, efficiently prevents a portion of the household tissues P projecting from the dispensing opening 11 from falling into the container space S.

Further, the household tissue case 1 may be configured to store the household tissues P folded and stacked in such a specific manner that a tissue has a low popup height when situated closer to the upper face, and the height of a popup increases as the distance to the lower face decreases. Here, the term "the height of a popup" refers to the length of a projection of the uppermost household tissue P as measured in the vertical direction, i.e., the length from the upper face of the tissue stack Q to the tip of the projection of the uppermost household tissue P projecting from the dispensing opening 11.

In the case of the manner of folding being the same throughout the tissue stack, the length of a projection of the household tissues P (i.e., the length of a projection extending from the dispensing opening 11) is longer at the beginning of use, and becomes shorter toward the end of use.

The height of a popup depends on the width of folding. Accordingly, a certain manner of folding may be made such that the height of a popup is shorter at the beginning of use, and becomes longer toward the end of use. The use of the tissue stack Q folded in such a manner allows the length of a projection of the household tissues P to be substantially constant from the beginning of use to the end of use. This arrangement can thus prevent the projection extending from the dispensing opening 11 from falling into the container space S, and can prevent the projection extending from the dispensing opening 11 from jamming into the upper lid 20 when the upper lid 20 is opened or closed.

The present invention is also applicable to the configuration in which a lid disposed at the upper face of the case for storing household tissues is opened and closed by vertically rotating its open end.

Further, the details of the configuration of the household tissue case can also be modified as appropriate without departing from the scope of the present invention.

INDUSTRIAL APPLICABILITY

The present invention is applicable to a household tissue case.

DESCRIPTION OF REFERENCE SYMBOLS

1 household tissue case
10 casing 10 (case unit)
11 dispensing opening
14 case-side packing (frame member)
14*a* projection
14*b* restricting portion
20 upper lid (lid)
30 chassis (case unit)
P household tissues
T enclosure

The invention claimed is:

1. A household tissue case, comprising:

a casing having a dispensing opening in an upper face thereof and configured to store household tissues therein; and a lid configured to open and close the dispensing opening, wherein a frame member is attached to a perimeter of the dispensing opening, the frame member being made of an elastic member, restricting portions being disposed at opposite ends of the frame member in a short-side direction of the casing in a plan view and extending in such a directions as to cover the dispensing opening, and the restricting portions being arranged to avoid overlapping each other such that tips thereof are staggered in a long-side direction of the casing in a plan view, thereby forming a letter-Z-shaped cut in the frame member, wherein the dispensing opening is situated off a center of gravity of the household tissue case in a plan view when the lid is in an open position, and the frame member has a projection disposed on the same side of the dispensing opening in the plan view as the center of gravity and extending in such a direction as to cover the dispensing opening such as not to overlap the restricting portions, the projection extending from a proximal end thereof to a distal end thereof perpendicularly to two short sides of the casing in the plan view, each of the restricting portions extending from a proximal end thereof to a distal end thereof perpendicularly to two long sides of the casing in the plan view, wherein the projection is an arc shape, and each of the restricting portions is a generally triangular shape, and wherein the projection extends perpendicularly to the restriction portions in the plan view such that, in the direction perpendicular to the two short sides of the casing in the plan view, the distal end of the projection is situated further toward the center of gravity than the distal ends of the restriction portions.

2. The household tissue case as claimed in claim 1, wherein the household tissues are folded and stored in the casing, and a fold direction of the household tissues is parallel to the long-side direction of the casing in a plan view.

3. The household tissue case as claimed in claim 1, wherein the frame member is made of elastomer resin.

4. The household tissue case as claimed in claim 1, wherein the lid is slid relative to the casing to open and close the dispensing opening.

5. The household tissue case as claimed in claim 1, wherein the projection having the arc shape is smaller than the restricting portions.

6. The household tissue case as claimed in claim 1, wherein a first one of the restricting portions is a generally isosceles triangular shape, and a second one of the restricting portions is a generally right triangular shape.

7. The household tissue case as claimed in claim 1, wherein the frame member is made of elastomer resin having a hardness of 90°.

8. The household tissue case as claimed in claim 1, wherein the distal end of the projection faces one of the restriction portions that is situated furthest away from the center of gravity among the restriction portions.

* * * * *